US011455953B1

(12) United States Patent
Xi et al.

(10) Patent No.: US 11,455,953 B1
(45) Date of Patent: Sep. 27, 2022

(54) PIXEL DRIVING CIRCUIT, DISPLAY DEVICE AND OPERATING METHOD THEREOF

(71) Applicant: AU Optronics Corporation, Hsin-Chu (TW)

(72) Inventors: Peng-Bo Xi, Hsin-Chu (TW); Chen-Chi Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/514,196

(22) Filed: Oct. 29, 2021

(30) Foreign Application Priority Data

Jun. 3, 2021 (TW) ..... 110120237

(51) Int. Cl.
*G09G 3/3233* (2016.01)
*G09G 3/32* (2016.01)

(52) U.S. Cl.
CPC ..... *G09G 3/3233* (2013.01); *G09G 3/32* (2013.01); *G09G 2300/0819* (2013.01); *G09G 2300/0852* (2013.01); *G09G 2300/0861* (2013.01); *G09G 2300/0876* (2013.01); *G09G 2310/067* (2013.01); *G09G 2310/08* (2013.01); *G09G 2320/0247* (2013.01)

(58) Field of Classification Search
CPC ..... G09G 3/3233; G09G 3/32; G09G 2300/0819; G09G 2300/0852; G09G 2300/0861; G09G 2300/0876; G09G 2310/067; G09G 2310/08; G09G 2320/0247
See application file for complete search history.

(56) References Cited

U.S. PATENT DOCUMENTS 8,823,614 B2 * 9/2014 Lee ..... G09G 3/3233 345/82
8,823,621 B2 * 9/2014 Chu ..... G09G 3/3677 345/94
9,078,301 B2 * 7/2015 Li ..... H05B 47/10
9,524,691 B2 * 12/2016 Li ..... G09G 3/3648
2009/0189883 A1 * 7/2009 Chung ..... G09G 5/00 345/213
2012/0032995 A1 * 2/2012 Lee ..... G09G 3/3233 345/77

(Continued)

FOREIGN PATENT DOCUMENTS

TW I722955 B 3/2021

*Primary Examiner* — Michael J Jansen, II
(74) *Attorney, Agent, or Firm* — WPAT, PC

(57) ABSTRACT

A display device includes pixel driving circuits. A first pixel driving circuit includes a light emitting element, first and second driving units and a control unit. The light emitting element emits light according to a current. The first driving unit generates the current. The second driving unit drives the first driving unit to adjust the current according to a first scanning signal. The control unit controls the first driving unit to adjust the current according to a first light emitting signal. The first scanning signal has first slope to third slopes during first to third periods, respectively. The first to third slopes are different from each other. The first light emitting signal has an enable voltage level during the first and third periods, and has a disable voltage level during the second period. The first to third periods are arranged continuously in order.

20 Claims, 8 Drawing Sheets

(56) References Cited

U.S. PATENT DOCUMENTS

| | | | | |
|---|---|---|---|---|
| 2012/0050244 | A1* | 3/2012 | Chu | G09G 3/3677 327/170 |
| 2013/0234626 | A1* | 9/2013 | Li | H05B 47/10 315/360 |
| 2015/0287377 | A1* | 10/2015 | Li | G09G 3/3648 345/212 |
| 2018/0182279 | A1 | 6/2018 | Sakariya et al. | |
| 2021/0118353 | A1 | 4/2021 | Sakariya et al. | |
| 2022/0199001 | A1* | 6/2022 | Kim | G09G 3/32 |

* cited by examiner

PIXEL DRIVING CIRCUIT, DISPLAY DEVICE AND OPERATING METHOD THEREOF

CROSS-REFERENCE TO RELATED APPLICATION

This application claims priority to Taiwan Application Serial Number 110120237, filed Jun. 3, 2021, which is herein incorporated by reference in its entirety.

BACKGROUND

Technical Field

The present disclosure relates to a display technology. More particularly, the present disclosure relates to a display device, a pixel driving circuit and an operating method of a display device.

Description of Related Art

When a display device drives a panel of light emitting diodes (LED), the display device operates according to pulse-width modulation (PWM) signals. However, performing operations based on the PWM signals may cause deficiencies such as accumulating a large amount of currents in the display device, requirements of complicate designs for circuits of the display device, and screen flickers. Thus, techniques associated with the development for overcoming the problems described above are important issues in the field.

SUMMARY

The present disclosure provides a display device. The display device includes pixel driving circuits coupled in series with each other. A first pixel driving circuit of the pixel driving circuits includes a light emitting element, a first driving unit, a second driving unit and a control unit. The light emitting element is configured to emit light according to a current. The first driving unit is configured to generate the current. The second driving unit is configured to drive the first driving unit to adjust the current according to a first scanning signal. The control unit is configured to control the first driving unit to adjust the current according to a first light emitting signal. The first scanning signal has a first slope, a second slope and a third slope during a first period, a second period and a third period, respectively. The first slope, the second slope and the third slope are different from each other. The first light emitting signal has an enable voltage level during the first period and the third period, and has a disable voltage level during the second period. The first period, the second period and the third period are arranged continuously in order.

The present disclosure also provides an operating method of a display device. The operating method includes: adjusting a current according to a first scanning signal and a first light emitting signal; adjusting a voltage level of the first scanning signal by a first slope, a second slope and a third slope during a first period, a second period and a third period, respectively, wherein the first period, the second period and the third period are arranged continuously in order; adjusting a voltage level of the first light emitting signal to a enable voltage level during the first period and the third period; adjusting the voltage level of the first light emitting signal to a disable voltage level during the second period; the current flowing through a light emitting element; and the light emitting element emitting light based on the current.

The present disclosure also provides a pixel driving circuit, the pixel driving circuit includes a light emitting element, a driving unit and a control unit. The light emitting element is configured to receive a current to emit light. The driving unit is configured receive a first scanning signal to adjust the current. The control unit is configured to receive a first light emitting signal to adjust the current. A voltage level of the first scanning signal is decreased during decreasing periods, and a voltage level of the first scanning signal has a slope substantially equal to zero during light emitting periods. The decreasing periods and the light emitting periods are arranged alternately in a frame time.

It is to be understood that both the foregoing general description and the following detailed description are by examples, and are intended to provide further explanation of the disclosure as claimed.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
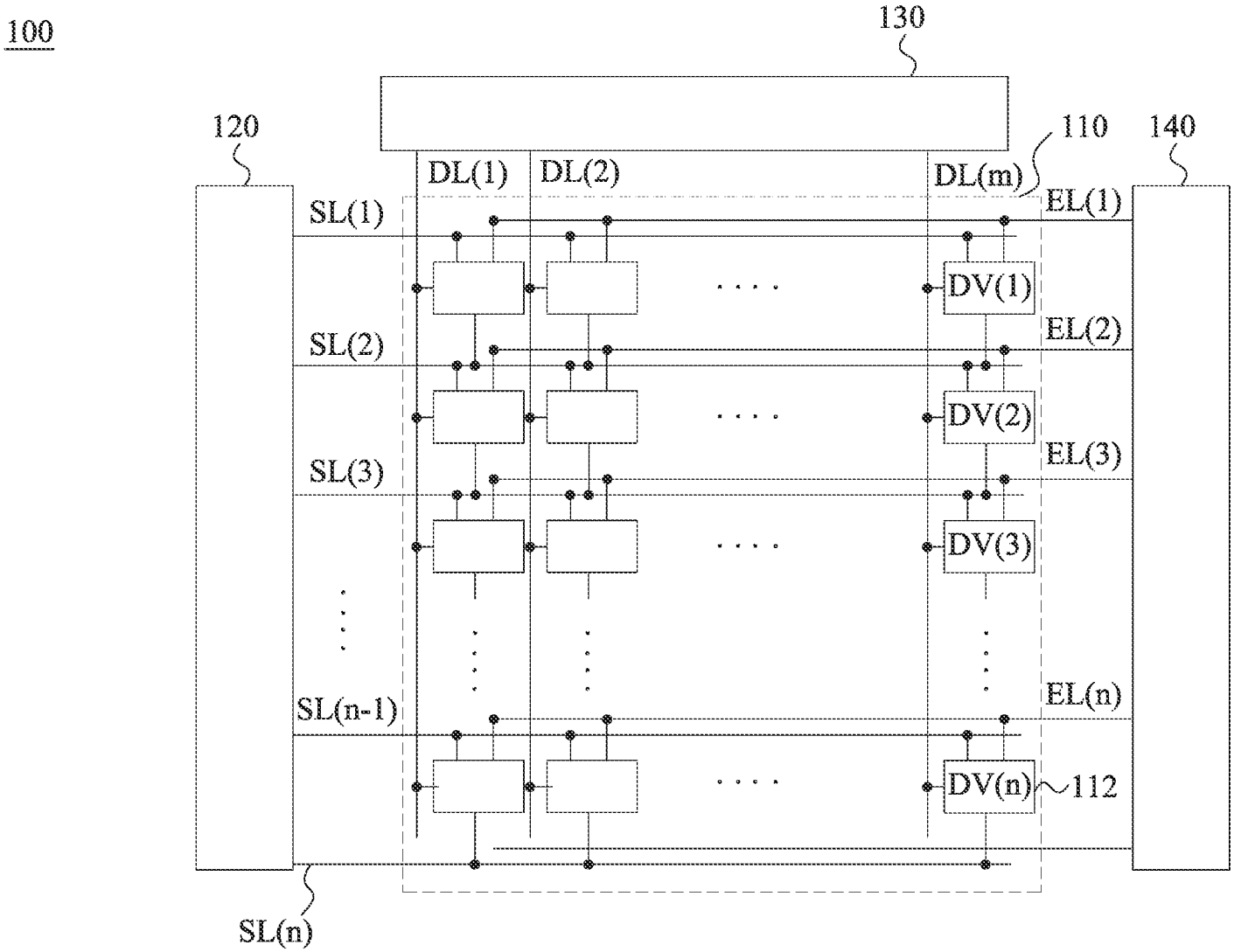
FIG. 1 is a schematic diagram of a display illustrated according to one embodiment of this disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The terms applied throughout the following descriptions and claims generally have their ordinary meanings clearly established in the art or in the specific context where each term is used. Those of ordinary skill in the art will appreciate that a component or process may be referred to by different names. Numerous different embodiments detailed in this specification are illustrative only, and in no way limits the scope and spirit of the disclosure or of any exemplified term.

It is worth noting that the terms such as "first" and "second" used herein to describe various elements or processes aim to distinguish one element or process from another. However, the elements, processes and the sequences thereof should not be limited by these terms. For example, a first element could be termed as a second element, and a second element could be similarly termed as a first element without departing from the scope of the present disclosure.

In the following discussion and in the claims, the terms "comprising," "including," "containing," "having," "involving," and the like are to be understood to be open-ended, that is, to be construed as including but not limited to. As used herein, instead of being mutually exclusive, the term "and/or" includes any of the associated listed items and all combinations of one or more of the associated listed items.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a schematic diagram of a display 100 illustrated according to one embodiment of this disclosure. As illustratively shown in FIG. 1, a display 100 includes a display device 110, a scan device 120, a data input device 130 and a light emitting controlling device 140. In some embodiments, the display 100 may be manufactured by a glass substrate or a plastic substrate, but the present disclosure is not limited to such embodiments.

Figure 2:
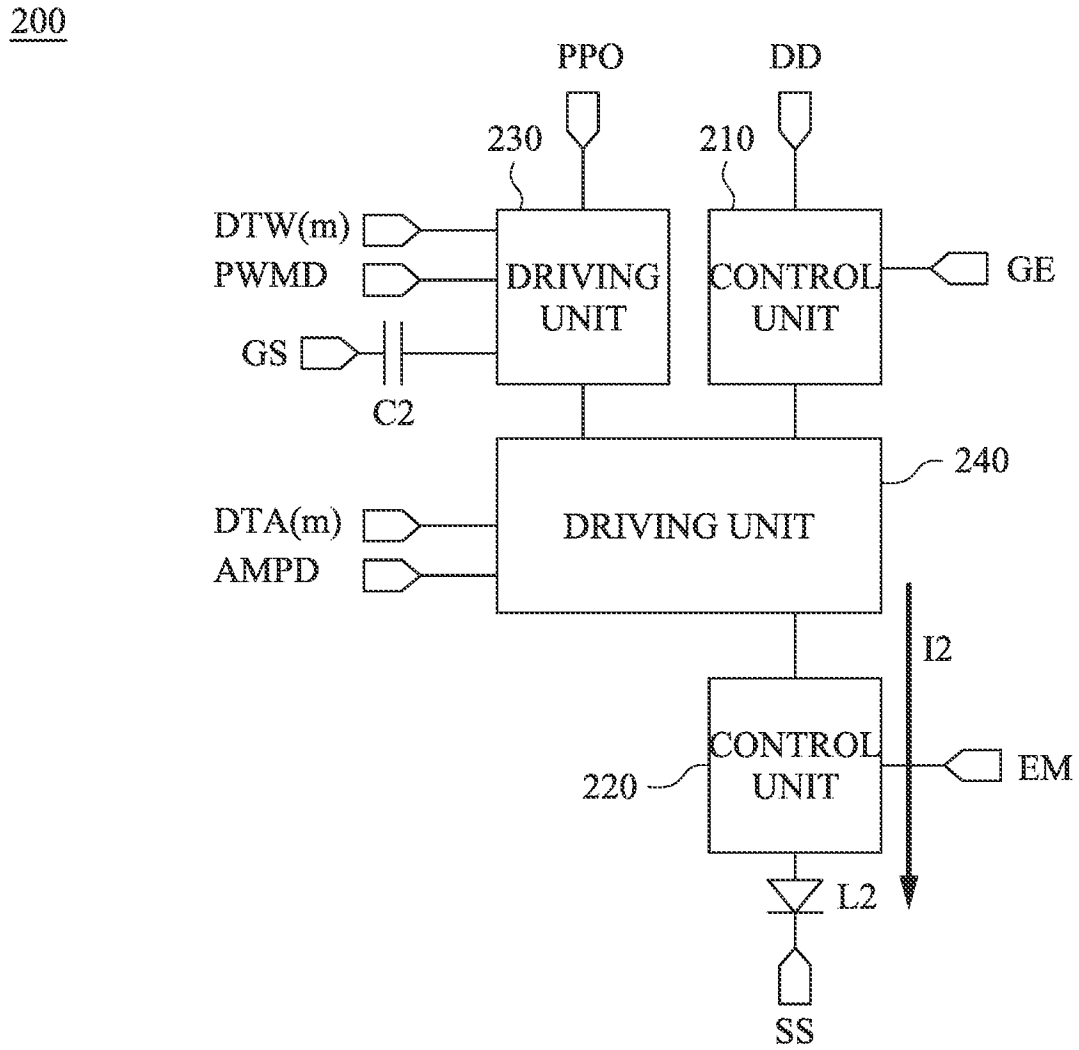
FIG. 2 is a block diagram of a pixel driving circuit in a display device illustrated according to one embodiment of this disclosure.

In some embodiments, the scan device 120 is configured to provide scanning signals, such as a scanning signal GS shown in FIG. 2, to the display device 110 by scan lines SL(1)-SL(n). The data input device 130 is configured to provide data signals, such as data signals DTW(m) and DTA(m) shown in FIG. 2, to the display device 110 by data lines DL(1)-DL(m). The light emitting controlling device 140 is configured to provide light emitting signals, such as a light emitting signal EM shown in FIG. 2, to the display device 110 by light emitting lines EL(1)-EL(n). It is noted that n and m are positive integers.

In some embodiments, the scan device 120 is further configured to provide other signals shown in FIG. 2, such as a driving signal PWMD, AMPD and a pinch off signal PPO, to the display device 110, but the present disclosure is not limited to such embodiments. In various embodiments, methods of providing the driving signal PWMD, AMPD and the pinch off signal PPO to the display device 110 are contemplated as within the scope of present disclosure.

As illustratively shown in FIG. 1, the display device 110 includes multiple stages of pixel driving circuits DV(1)-DV(n) coupled in series with each other. The pixel driving circuits DV(1)-DV(n) include a pixel driving circuit 112. In some embodiments, the pixel driving circuit 112 included in the display device 110 performs driving operations according to the signals provided by the scan device 120, the data input device 130 and the light emitting controlling device 140.

FIG. 2 is a block diagram of a pixel driving circuit in a display device illustrated according to one embodiment of this disclosure. The pixel driving circuit 200 is an embodiment of the pixel driving circuit 112 in the display device 110.

As illustratively shown in FIG. 2, the pixel driving circuit 200 includes control units 210, 220 and driving units 230, 240. As illustratively shown in FIG. 2, the pixel driving circuit 200 includes a capacitor C2 and a light emitting element L2. In various embodiments, the light emitting element L2 can be implemented by a micro light emitting diode (mLED), an organic light emitting diode (OLED) or another type of light emitting element.

As illustratively shown in FIG. 2, the driving unit 240 is configured to generate a current I2 according to the data signal DTA(m), such that the light emitting element L2 emits light according to the current I2. In some embodiments, the data signal DTA(m) is a pulse amplitude modulation (PAM) data signal. In some embodiments, the driving unit 240 is further configured to adjust a current value of the current I2 according to a driving signal AMPD, such that the current I2 is maintained at a best efficiency point of the emitting element L2.

As illustratively shown in FIG. 2, the control unit 220 is configured to receive the current I2, and provide the current I2 to the emitting element L2 according to the emitting signal EM, such that the emitting element L2 emits light according to the current I2.

As illustratively shown in FIG. 2, the control unit 210 is configured to control the driving unit 240 according to a light emitting signal GE, to adjust the current I2. In some embodiments, the control unit 210 is further configured to receive a voltage signal DD having a voltage level VDD.

As illustratively shown in FIG. 2, the driving unit 230 is configured to receive the scanning signal GS via the capacitor C2, and operate the driving unit 240 according to the scanning signal GS, to adjust the current I2. In some embodiments, the driving unit 230 is further configured to cutoff the current I2 at a certain time according to the pinch off signal PPO.

As illustratively shown in FIG. 2, a terminal of the emitting element L2 is coupled to the control unit 220, another terminal of the emitting element L2 is configured to receive a voltage signal SS having a voltage level VSS. In some embodiments, the voltage level VDD is larger than the voltage level VSS.

Figure 3:
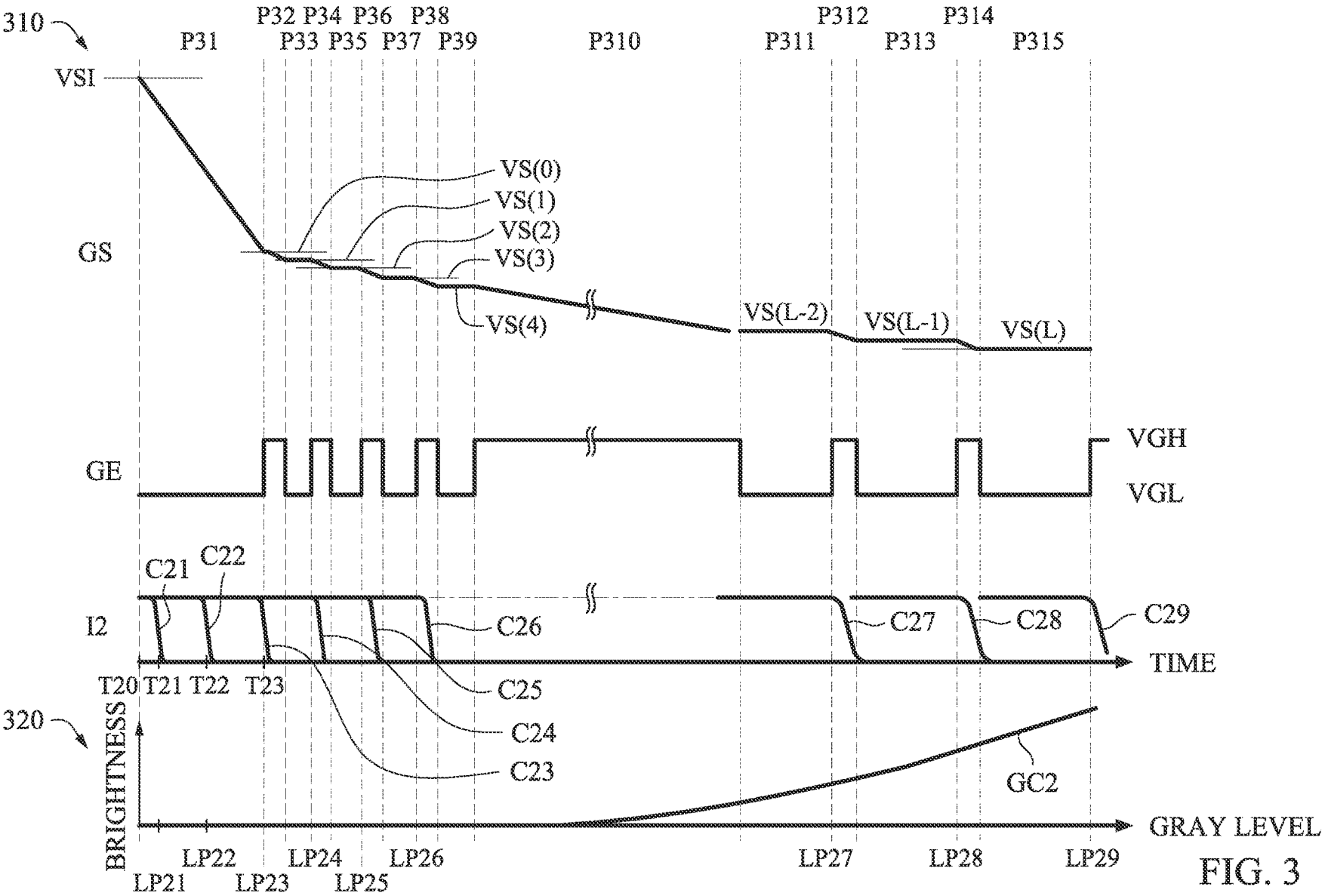
FIG. 3 is a timing diagram of a pixel driving circuit performing light emitting operations, and a corresponding relationship diagram of gray levels and brightness, illustrated according to one embodiment of this disclosure.

FIG. 3 is a timing diagram 310 of the pixel driving circuit 200 performing light emitting operations, and a corresponding relationship diagram 320 of gray levels and brightness, illustrated according to one embodiment of this disclosure.

As illustratively shown in FIG. 3, a horizontal axis of the timing diagram 310 corresponds to time, and a vertical axis of the timing diagram 310 corresponds to voltage levels and current levels. The timing diagram 310 includes periods P31-P315 arranged continuously in order. In some embodiments, the periods P31-P315 correspond to a frame time. In some embodiments, the timing diagram 310 corresponds to operations of various signals shown in FIG. 2, such as operations of the scanning signal GS and the light emitting signal GE.

In some embodiments, the timing diagram 310 includes curves C21-C29. The curves C21-C29 correspond to different operations of the current I2 shown in FIG. 2, according to different conditions of the pixel driving circuit. For example, the curve C21 corresponds to an embodiment that the current I2 is cutoff at a moment T21, the curve C22 corresponds to an embodiment that the current I2 is cutoff at a moment T22, the curve C23 corresponds to an embodiment that the current I2 is cutoff at a moment T23, and so on. In some embodiments, the current I2 being cutoff means that the current level of the current I2, which passes through the light emitting element L2, is pulled to zero current level, and thus the light emitting element L2 does not emit light. In other words, in the embodiments corresponding to the curve C21, the light emitting element L2 emits light from a moment T20 until a moment T21, and stops to emit light at the moment T21. In the embodiments corresponding to the curve C22, the light emitting element L2 emits light from the moment T20 until a moment T22, and stops to emit light at the moment T22. In the embodiments corresponding to the curve C23, the light emitting element L2 emits light from the moment T20 until a moment T23, and stops to emit light at the moment T23, and so on.

As illustratively shown in FIG. 3, a horizontal axis of the relationship diagram 320 corresponds to a gray level sensed by human eyes when a human observes the pixel driving circuit 200, and a vertical axis of the relationship diagram 320 corresponds to brightness of the pixel driving circuit 200. In some embodiments, the gray level is increased when the brightness is increased. As illustratively shown in FIG. 3, the relationship diagram 320 includes a curve GC2. The curve GC2 illustrates different gray levels corresponding to different brightness of the pixel driving circuit 200. In some embodiments, the curve GC2 is a monotonic increasing function. As illustratively shown in FIG. 3, a slope of the curve GC2 is smaller when the gray level is lower, and the slope of the curve GC2 is larger when the gray level is higher. In other words, comparing with conditions with higher gray levels, when the gray level is lower, effects of the brightness to the gray level is stronger. In some embodiments, the relationship diagram 320 corresponds to gamma relationship. In other words, the relationship diagram 320 is a gamma curve diagram in some embodiments.

Referring to the timing diagram 310 and the relationship diagram 320, in some embodiments, the gray level is increased when a time length of the light emitting element L2 emitting light is increased. For example, in the embodiment corresponding to the curve C21, the light emitting element L2 emits light from the moment T20 until the moment T21, and the pixel driving circuit 200 has a corresponding gray level LP21. In the embodiment corresponding to the curve C22, the light emitting element L2 emits light from the moment T20 until the moment T22, and the pixel driving circuit 200 has a corresponding gray level LP22. As illustratively shown in FIG. 3, a time length from the moment T20 to the moment T22 is larger than a time length from the moment T20 to the moment T21. Correspondingly, the gray level LP22 is larger than the gray level LP21. Similarly, a gray level LP23 corresponding to the curve C23 is larger than the gray level LP22 corresponding to the curve C22. As described above, the pixel driving circuit 200 may cutoff the current I2 at different moments to adjust the gray level of the pixel driving circuit 200.

As illustratively shown in FIG. 3, during the period P31, the scanning signal GS is pulled from a voltage level VSI to a voltage level VS(0), and has a first slope. In some embodiments, the first slope is equal to ((VSI−VS(0)/the time length of the period P31). In some embodiments, the first slope corresponds to low gray levels. For example, the first slope corresponds to gray level values which are smaller or equal to thirty-two.

During the period P31, the light emitting signal GE has an enable voltage level VGL, the control unit 210 controls the driving unit 240 according to the light emitting signal GE, and the driving unit 230 may control the driving unit 240, according to the pinch off signal PPO, to cutoff the current I2. For example, the driving unit 240 may cutoff the current I2 at the moment T21, the moment T22 or the moment T23 according to different pinch off signals PPO, but embodiments of present disclosure are not limited to this. In various embodiments, the driving unit 240 may cutoff the current I2 at various moments in the period P31 according to the pinch off signal PPO.

As illustratively shown in FIG. 3, during the period P32, the scanning signal GS is pulled from a voltage level VS(0) to a voltage level VS(1), and has a second slope. In some embodiments, the second slope is equal to ((VS(0)−VS(1)/the time length of the period P32). In some embodiments, the first slope is larger than the second slope.

During the period P32, the light emitting signal GE has the disable voltage level VGH, and the driving unit 240 may cutoff the current I2 during the period P32 according to the pinch off signal PPO. In some embodiments, if the current I2 is cutoff during the period P32, the pixel driving circuit has a gray level value thirty-two.

As illustratively shown in FIG. 3, during the period P33, the scanning signal GS has the voltage level VS(1), and has a slope substantially equal to zero. In some embodiments, the second slope corresponding to the period P32 is larger than zero.

During the period P33, the light emitting signal GE has the enable voltage level VGL, the control unit 210 controls the driving unit 240 according to the light emitting signal GE, such that the driving unit 240 provides the current I2 to the light emitting element L2. If the current I2 does not be cutoff during the period P32, the light emitting element L2 emits light during the period P33.

As illustratively shown in FIG. 3, during the period P34, the scanning signal GS is pulled from a voltage level VS(1) to a voltage level VS(2), and has a third slope. In some embodiments, the third slope is equal to ((VS(1)-VS(2)/the time length of the period P34). In some embodiments, the first slope is larger than the third slope. In various embodiments, the third slope may be same as or different from the second slope. In some embodiments, the third slope is larger than zero.

During the period P34, the light emitting signal GE has a disable voltage level VGH, and the driving unit 240 may cutoff the current I2 during the period P34 according to the pinch off signal PPO. The curve C24 corresponds to an embodiment that the current I2 is cutoff during the period P34.

Referring to the timing diagram 310 and the relationship diagram 320, in some embodiments, if the current I2 is cutoff during the period P34, the pixel driving circuit 200 has a corresponding gray level LP24. In some embodiments, the gray level LP24 corresponds to a gray level value thirty-three.

As illustratively shown in FIG. 3, during the period P35, the scanning signal GS has the voltage level VS(2), and a slope of the scanning signal GS is substantially equal to zero.

During the period P35, the light emitting signal GE has the enable voltage level VGL, the control unit 210 controls the driving unit 240 according to the light emitting signal GE, such that the driving unit 240 provides the current I2 to the light emitting element L2. If the current I2 does not be cutoff during the period P34, the light emitting element L2 emits light according to the current I2 during the period P35.

As illustratively shown in FIG. 3, during the period P36, the scanning signal GS is pulled from a voltage level VS(2) to a voltage level VS(3), and has a fourth slope. In some embodiments, the fourth slope is equal to ((VS(2)−VS(3)/the time length of the period P36). In some embodiments, the first slope is larger than the fourth slope. In various embodiments, the fourth slope may be same as or different from the second slope and/or the third slope. In some embodiments, the fourth slope is larger than zero.

During the period P36, the light emitting signal GE has the disable voltage level VGH, and the driving unit 240 may cutoff the current I2 during the period P36 according to the pinch off signal PPO. The curve C25 corresponds to an embodiment that the current I2 is cutoff during the period P36.

Referring to the timing diagram 310 and the relationship diagram 320, in some embodiments, if the current I2 is cutoff during the period P36, the pixel driving circuit 200 has a corresponding gray level LP25. In some embodiments, the gray level LP25 corresponds to a gray level value thirty-four.

As shown in the relationship diagram 320, when the gray level is higher, a time length of emitting light for further increasing the gray level is longer. In other words, comparing with a time length of the period P33 corresponding to increasing the gray level value from thirty-two to thirty-three, a time length of the period P35 corresponding to increasing the gray level value from thirty-three to thirty-four is longer.

As illustratively shown in FIG. 3, during the period P37, the scanning signal GS has the voltage level VS(3), and a slope of the scanning signal GS is substantially equal to zero.

During the period P37, the light emitting signal GE has the enable voltage level VGL, the control unit 210 controls the driving unit 240 according to the light emitting signal GE, such that the driving unit 240 provides the current I2 to the light emitting element L2. If the current I2 does not be cutoff during the period P36, the light emitting element L2 emits light according to the current I2 during the period P37.

As illustratively shown in FIG. 3, during the period P38, the scanning signal GS is pulled from a voltage level VS(3) to a voltage level VS(4), and has a fifth slope. In some embodiments, the fifth slope is equal to ((VS(3)-VS(4)/the time length of the period P38). In some embodiments, the first slope is larger than the fifth slope. In various embodiments, the fifth slope may be same as or different from the second slope, the third slope and/or the fourth slope.

During the period P38, the light emitting signal GE has the disable voltage level VGH, and the driving unit 240 may cutoff the current I2 during the period P38 according to the pinch off signal PPO. The curve C26 corresponds to an embodiment that the current I2 is cutoff during the period P38.

Referring to the timing diagram 310 and the relationship diagram 320, in some embodiments, if the current I2 is cutoff during the period P38, the pixel driving circuit 200 has a corresponding gray level LP26. In some embodiments, the gray level LP26 corresponds to a gray level value thirty-five.

As shown in the relationship diagram 320, when the gray level is higher, a time length of emitting light for further increasing the gray level is longer. In other words, comparing with a time length of the period P35 corresponding to increasing the gray level value from thirty-three to thirty-four, a time length of the period P37 corresponding to increasing the gray level value from thirty-four to thirty-five is longer.

In some embodiments, starting from the period P33, time lengths of periods (such as the periods P35, P37) of the light emitting signal GE having the enable voltage level VGL are increased gradually in order according to the curve GC2 with respect to the gray levels. For example, comparing with a time length of a period corresponding to the gray level value being increased from K to (K+1), a time length of a period corresponding to the gray level value being increased from (K+1) to (K+2) is longer. In some embodiments, K is an integer larger than thirty-two.

Operations during the period P39 are similar with the operations during the period P37, and thus some descriptions are not repeated for brevity. In some embodiments, a time length of the period P39 is larger than the time length of the period P37.

During the period P310, the pixel driving circuit 200 performs operations similar with the operations during the periods P32-P39. During the period P310, the light emitting signal GE is switched between the enable voltage level VGL and the disable voltage level VGH, and the time lengths of the periods of the light emitting signal GE having the enable voltage level VGL are increased gradually with respect to the increasing of the gray level. The scanning signal GS is decreased when the light emitting signal GE having the disable voltage level VGH, and has multiple slopes which are different from or same as each other. The scanning signal GS has slopes substantially equal to zero when the light emitting signal GE having the enable voltage level VGL. The driving unit 240 may cutoff the current I2, according to the pinch off signal PPO, in the periods that the light emitting signal GE has the disable voltage level VGH, to achieve desired gray levels.

Operations of the pixel driving circuit 200 during the periods P311-P315 corresponding to the voltage levels VS(L−2), VS(L−1) and VS(L) are similar with the operations of the pixel driving circuit 200 during the periods P35-P37 corresponding to the voltage levels VS(1), VS(2) and VS(3), and thus some descriptions are not repeated for brevity. In some embodiments, the integer L corresponds to a highest gray level of the pixel driving circuit 200. In some embodiments, the integer L is larger than two hundred forty.

Referring to the timing diagram 310 and the relationship diagram 320, the curves C27-C29 correspond to embodiments of the pixel driving circuit 200 having the gray levels LP27-LP29, respectively.

In some embodiments, during the periods P32, P34, P36, P38, P312 and P314, voltage levels of the scanning signal GS are decreased. Accordingly, the periods P32, P34, P36, P38, P312 and P314 are referred to as decreasing periods. In some embodiments, during the periods P33, P35, P37, P39, P311, P313 and P315, the light emitting element L2 emits light according to the current I2. Accordingly, the periods P33, P35, P37, P39, P311, P313 and P315 are referred to as light emitting periods.

As illustratively shown in FIG. 3, during the periods P32-P315, multiple decreasing periods and multiple light emitting periods are arranged alternately. The light emitting signal GE has the disable voltage level VGH in the light emitting periods, and has the enable voltage level VGL in the decreasing periods.

As illustratively shown in FIG. 3, time lengths of the light emitting periods are increased gradually in order in the frame time. For example, the time lengths of the periods P33, P35, P37, P39, P311, P313 and P315 are increased gradually in order. Each of the light emitting periods corresponds to a gray level of the pixel driving circuit 200, and the periods P31 may corresponds to multiple gray levels of the pixel driving circuit 200. For example, the periods P32, P34, P36 and P38 correspond to the gray levels LP23, LP24, LP25 and LP26, respectively, and the period P31 may correspond to any gray level which is lower than or equal to the gray level LP23.

In some approaches, due to light emitting periods corresponding to low gray levels are very short, panels of types with short light emitting period (such as multi-pulse mode) are suffer from very short light emitting periods. As a result, it is hard to control and adjust gray levels of a pixel driving circuit.

Compared to the above approaches, in some embodiments of the present disclosure, the light emitting periods of low gray levels are carefully controlled by the operations during the period P31. For middle gray levels and high gray levels, the gray level is adjusted and controlled in a digital-like manner by multiple decreasing periods and light emitting periods being increased gradually in order, according to the gamma curve. As a result, by the operations of the scanning signal GS and the light emitting signal GE, the pixel driving circuit 200 is able to adjust and control the gray level more accurately.

Figure 4:
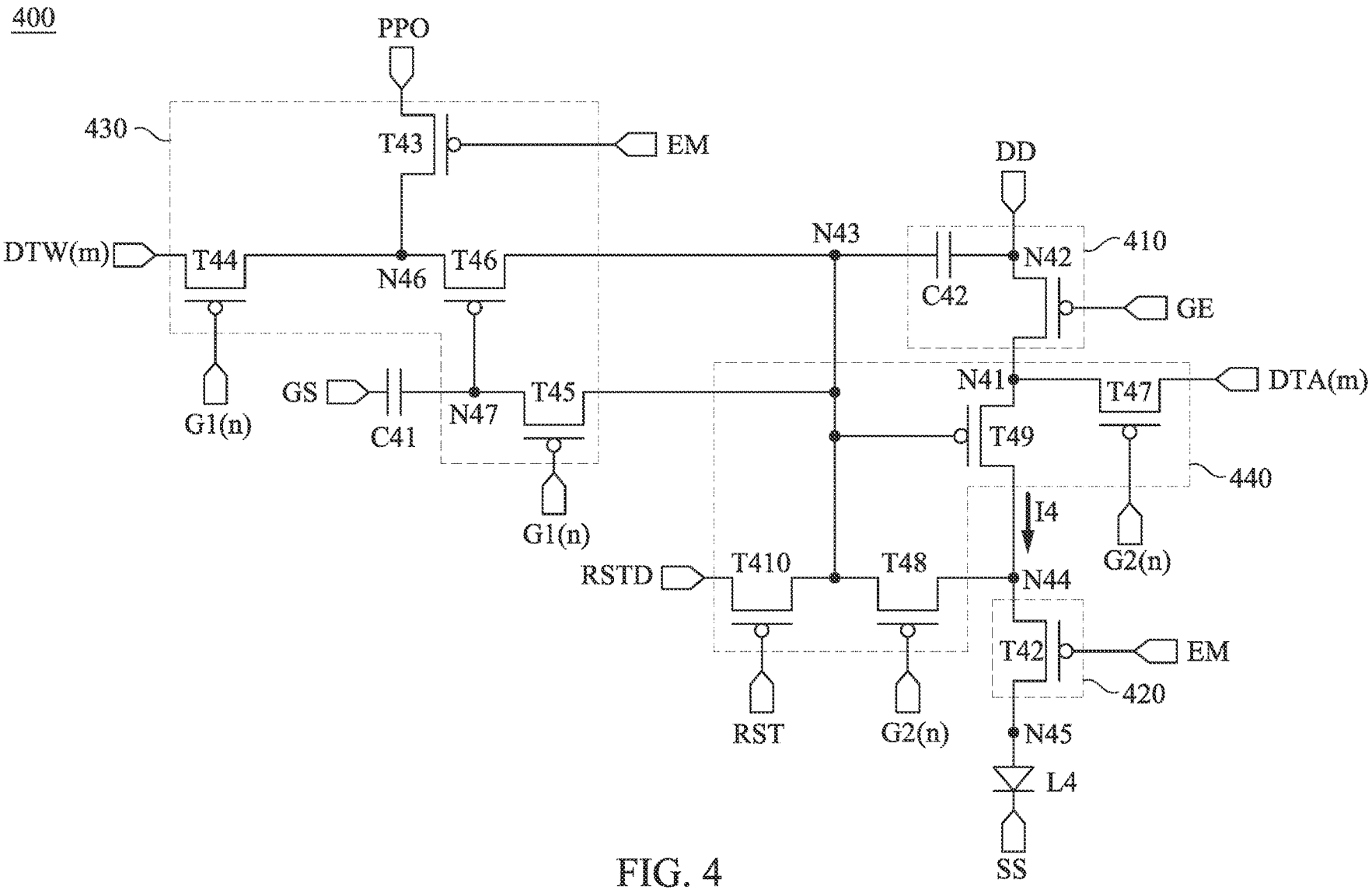
FIG. 4 is a block diagram of a pixel driving circuit in a display device illustrated according to one embodiment of this disclosure.

FIG. 4 is a block diagram of a pixel driving circuit 400 in the display device 110 illustrated according to one embodiment of this disclosure. The pixel driving circuit 400 is an embodiment of the pixel driving circuit 112 in the display device 110. The pixel driving circuit 400 is also an embodiment of the pixel driving circuit 200 shown in FIG. 2.

Referring to FIG. 2 and FIG. 4, the pixel driving circuit 400 includes control units 410, 420, driving units 430, 440, a light emitting element L4 and a capacitor C41. Functions and operations of the control units 410, 420, the driving units 430, 440, the light emitting element L4 and the capacitor C41 are similar with the control units 210, 220, the driving units 230, 240, the light emitting element L2 and the capacitor C2, and thus some descriptions are not repeated for brevity.

As illustratively shown in FIG. 4, the control unit 410 includes a switch T41 and a capacitor C42. A control terminal of the switch T41 is configured to receive the light emitting signal GE, a terminal of the switch T41 is configured to receive the voltage signal DD, another terminal of the switch T41 is coupled to a node N41. A terminal of the capacitor C42 is coupled to the switch T41 at a node N42, another terminal of the capacitor C42 is coupled to a node N43.

As illustratively shown in FIG. 4, the control unit 420 includes a switch T42. A terminal of the switch T42 is coupled to a node N44, another terminal of the switch T42 is coupled to the light emitting element L4 at a node N45.

As illustratively shown in FIG. 4, the driving unit 430 includes switches T43-T46. A control terminal of the switch T43 is configured to receive the light emitting signal EM, a terminal of the switch T43 is configured to receive the pinch off signal PPO, another terminal of the switch T43 is coupled to a node N46. A control terminal of the switch T44 is configured to receive the a control signal G1(*n*), a terminal of the switch T44 is configured to receive the data signal DTW(m), another terminal of the switch T44 is coupled to the node N46. A control terminal of the switch T45 is configured to receive the control signal G1(*n*), a terminal of the switch T45 is coupled to the node N43, another terminal of the switch T45 is coupled to the capacitor C41 at a node N47. A control terminal of the switch T46 is coupled to the node N47, a terminal of the switch T46 is coupled to the node N43, another terminal of the switch T46 is coupled to the node N46.

As illustratively shown in FIG. 4, the driving unit 440 includes switches T47-T410. A control terminal of the switch T47 is configured to receive a control signal G2(*n*), a terminal of the switch T47 is configured to receive the data signal DTA(m), another terminal of the switch T47 is coupled to the node N41. A control terminal of the switch T48 is configured to receive the control signal G2(*n*), a terminal of the switch T48 is coupled to the node N43, another terminal of the switch T48 is coupled to the node N44. A control terminal of the switch T49 is coupled to the node N43, a terminal of the switch T49 is coupled to the node N41, another terminal of the switch T49 is coupled to the node N44. A control terminal of the switch T410 is configured to receive a reset signal RST, a terminal of the switch T410 is coupled to the node N43, and another terminal of the switch T410 is configured to receive a voltage signal RSTD.

In some embodiments, the light emitting element L4 is configured to emit light according to a current I4 which flows through switches T41, T49 and T42 in order.

In the embodiment shown in FIG. 4, the switches T41-T410 are implemented as P-type Metal-Oxide-Semiconductor (PMOS) field-effect transistors, but embodiments of present disclosure are not limited to this. In various embodiments, the switches T41-T410 may be implemented as P-type Metal-Oxide-Semiconductor (PMOS) field-effect transistors, thin film transistor or other types of transistors.

Figure 5:
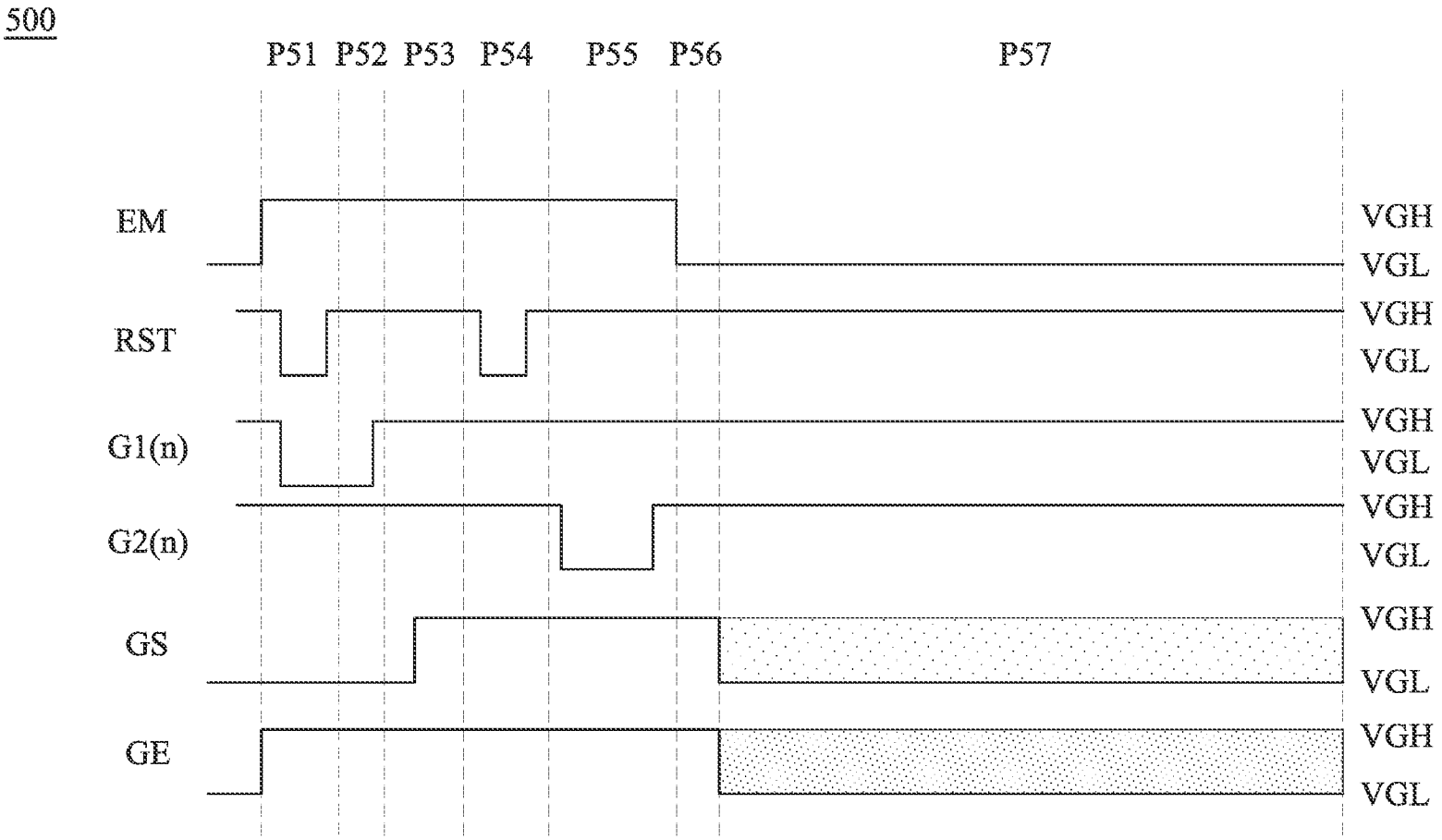
FIG. 5 is a timing diagram of a pixel driving circuit performing light emitting operations illustrated according to one embodiment of this disclosure.

FIG. 5 is a timing diagram 500 of the pixel driving circuit 400 performing light emitting operations illustrated according to one embodiment of this disclosure. The timing diagram 500 includes periods P51-P57 arranged in order. In some embodiments, the timing diagram 500 corresponds to operations of various signals shown in FIG. 4, such as the scanning signal GS, the light emitting signals EM, GE, the reset signal RST and the control signals G1(*n*) and G2(*n*).

As illustratively shown in FIG. 5, during the period P51, the reset signal RST and the control signal G1(*n*) have the enable voltage level VGL, such that the switches T410, T44 and T45 are turned on. At this moment, the voltage signal RSTD is written into the nodes N43 and N47 via the switches T410 and T45 in order, to reset voltages of nodes N43 and N47.

As illustratively shown in FIG. 5, during the period P52, the control signal G1(*n*) has the enable voltage level VGL, such that the switches T44 and T45 are turned on. The scanning signal GS has the enable voltage level VGL, such that the capacitor C41 pulls the voltage of the node N47 to an enable voltage level according to the scanning signal GS, to turn on the switch T46. The data signal DTW(m) is written into the node N47 via the switches T44, T46 and T45 in order. At this moment, the driving unit 430 compensates the voltage of the node N47 according to a threshold voltage level of the switch T46.

As illustratively shown in FIG. 5, during the period P53, the scanning signal GS is pulled to the voltage level VGH, such that the pixel driving circuit 400 is able to perform the light emitting operations during following light emitting periods (such as the period P57) according to the scanning signal GS which has a voltage level decreasing gradually. At this moment, the capacitor C41 is configured to store the data signal DTW(m) at the node N47, such that the light emitting element L4 is able to emit light according to the data signal DTW(m) during the following periods (such as the period P57).

As illustratively shown in FIG. 5, during the period P54, the reset signal RST has the enable voltage level VGL, such that the switch T410 is turned on. At this moment, the voltage signal RSTD is written into the node N43 via the switch T410 to reset the voltage of the node N43, and turns on the switch T49.

As illustratively shown in FIG. 5, during the period P55, the control signal G2(*n*) has the enable voltage level VGL, such that the switches T47 and T48 are turned on. The data signal DTA(m) is written into the node N43 via the switches T47, T49 and T48 in order. At this moment, the driving unit 440 compensates the voltage of the node N43 according to a threshold voltage level of the switch T49.

As illustratively shown in FIG. 5, during the period P56, the light emitting signal EM has the enable voltage level VGL, such that the switches T43 and T42 are turned on. In some embodiments, the switches T43 and T42 are turned on before the light emitting periods (such as the period P57), to ensure the light emitting element L4 is able to perform the light emitting operations according to the scanning signal GS and the light emitting signal GE during the light emitting periods.

As illustratively shown in FIG. 5, during the period P57, the light emitting signal EM has the enable voltage level VGL, such that the switches T43 and T42 are turned on. The switch T41 receives the voltage signal DD having the voltage level VDD, and is turned on according to the light emitting signal GE. The switch T49 is turned on according to the voltage of the node N43. At this moment, the current I4 passes through the switches T41, T49, T42 and the light emitting element L4 in order, such that the light emitting element L4 emits light according to the current level of the current I4. In some embodiments, the switch T41 adjust the current level of the current I4 according to the light emitting signal GE, and the switch T49 adjusts the current level of the current I4 according to the voltage of the node N49.

As illustratively shown in FIG. 5, during the period P57, the switch T46 is turned on according to the scanning signal GS, such that the pinch off signal PPO is written into the node N43 via the switches T43 and T46 in order, to adjust the voltage of the node N43. Accordingly, the switch T49 adjust the current level of the current I4 according to the scanning signal GS and the pinch off signal PPO.

In some embodiments, operations of the current I4, the scanning signal GS and the light emitting signal GE during the period P57 is similar with the operations of the current I2, the scanning signal GS and the light emitting signal GE during the periods P31-P315 shown in FIG. 2 and FIG. 3, and thus some descriptions are not repeated for brevity. In some embodiments, the period P57 includes the periods P31-P315.

Figure 6:
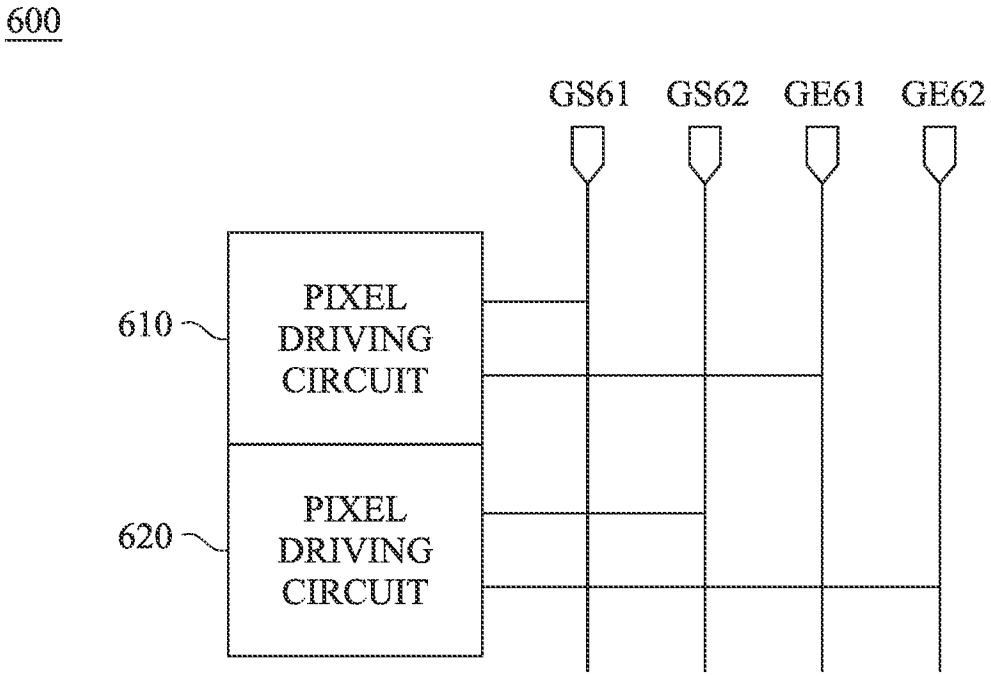
FIG. 6 is a schematic diagram of a display device illustrated according to one embodiment of this disclosure.

FIG. 6 is a schematic diagram of a display device 600 illustrated according to one embodiment of this disclosure. Referring to FIG. 1 and FIG. 6, the display device 600 is an embodiment of the display device 100. As illustratively shown in FIG. 6, the display device 600 includes pixel driving circuits 610 and 620. Referring to FIG. 2, FIG. 4 and FIG. 6, each of the circuits 610 and 620 may have configurations and connections similar with the pixel driving circuit 200 and/or the pixel driving circuit 400.

As illustratively shown in FIG. 6, the pixel driving circuit 610 is configured to receive a scanning signal GS61 and a light emitting signal GE61, and the pixel driving circuit 620 is configured to receive a scanning signal GS62 and a light emitting signal GE62. In some embodiments, operations of the pixel driving circuit 610 corresponding to the scanning signal GS61 and the light emitting signal GE61 are similar with the operations of the pixel driving circuit 200 and/or the pixel driving circuit 400 corresponding to the scanning signal GS and the light emitting signal GE. In some embodiments, operations of the pixel driving circuit 620 corresponding to the scanning signal GS62 and the light emitting signal GE62 are similar with the operations of the pixel driving circuit 200 and/or the pixel driving circuit 400 corresponding to the scanning signal GS and the light emitting signal GE. Therefore, some descriptions are not repeated for brevity.

Figure 7:
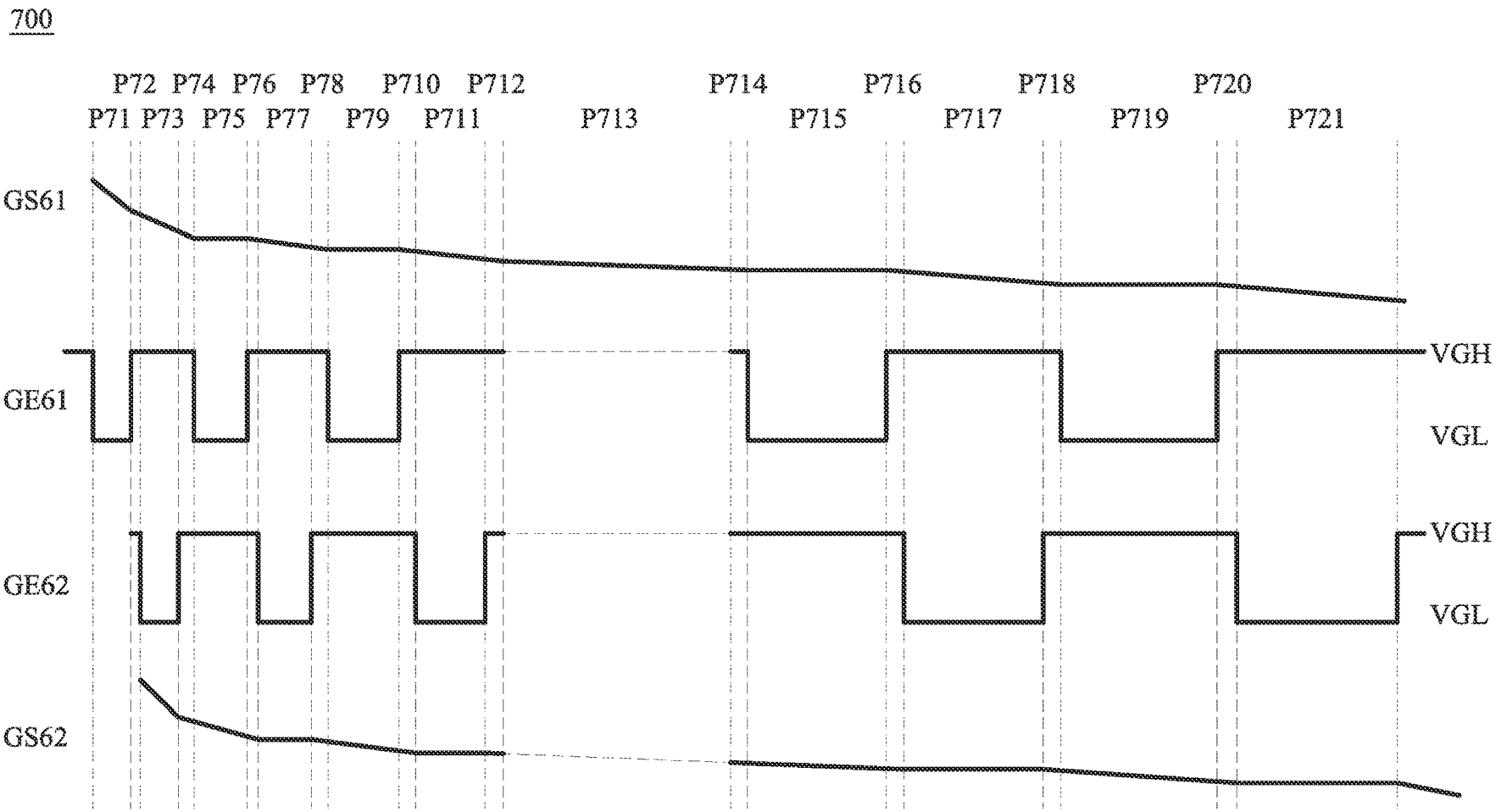
FIG. 7 is a timing diagram of pixel driving circuits performing light emitting operations illustrated according to one embodiment of this disclosure.

FIG. 7 is a timing diagram 700 of the pixel driving circuits 610 and 620 performing light emitting operations illustrated according to one embodiment of this disclosure.

As illustratively shown in FIG. 7, a horizontal axis of the timing diagram 700 corresponds to time, and a vertical axis of the timing diagram 700 corresponds to voltage levels and current levels. The timing diagram 700 includes periods P71-P721 arranged continuously in order. In some embodiments, the periods P71-P721 correspond to a frame time. In some embodiments, the timing diagram 700 corresponds to operations of various signals shown in FIG. 6, such as operations of the scanning signals GS61, GS62 and the light emitting signals GE61, GE62.

As illustratively shown in FIG. 7, during the period P71, the scanning signal GS61 is decreased and has the first slope. The light emitting signal GE61 has the enable voltage level VGL. The pixel driving circuit 610 is able to cutoff a current passing through the pixel driving circuit 610 during the period P71, to determine a gray level of the pixel driving circuit 610.

As illustratively shown in FIG. 7, during the periods P72-P74, the scanning signal GS61 is decreased and has the second slope different from the first slope. The light emitting signal GE61 has the disable voltage level VGH. The pixel driving circuit 610 is able to cutoff the current passing through the pixel driving circuit 610 during the periods P72-P74, to determine the gray level of the pixel driving circuit 610.

As illustratively shown in FIG. 7, during the period P75, a slope of the scanning signal GS61 is substantially equal to zero. The light emitting signal GE61 has the enable voltage level VGL. The pixel driving circuit 610 emits light or not according to whether the current is cutoff during the periods P72-P74.

As illustratively shown in FIG. 7, during the periods P76-P78, the scanning signal GS61 is decreased and has the third slope different from the first slope. In various embodiments, the third slope may be same as or different form the second slope. The light emitting signal GE61 has the disable voltage level VGH. The pixel driving circuit 610 is able to cutoff the current passing through the pixel driving circuit 610 during the periods P76-P78, to determine the gray level of the pixel driving circuit 610.

As illustratively shown in FIG. 7, during the period P79, a slope of the scanning signal GS61 is substantially equal to zero. The light emitting signal GE61 has the enable voltage level VGL. The pixel driving circuit 610 emits light or not according to whether the current is cutoff during the periods P76-P78.

As illustratively shown in FIG. 7, during the periods P710-P712, the scanning signal GS61 is decreased and has the fourth slope different from the first slope. In various embodiments, the fourth slope may be same as or different form the third slope. The light emitting signal GE61 has the disable voltage level VGH. The pixel driving circuit 610 is able to cutoff the current passing through the pixel driving circuit 610 during the periods P710-P712, to determine the gray level of the pixel driving circuit 610.

In some embodiments, time lengths of the periods P72-P74, P76-P78 and P710-P712 are increased gradually in order. In some embodiments, time lengths of the periods P75 and P79 are increased gradually in order.

During the period P713, the pixel driving circuit 610 performs operations similar with the operations performed during the periods P72-P712. During the period P713, the light emitting signal GE61 is switched between the enable voltage level VGL and the disable voltage level VGH. Time lengths of periods of the light emitting signal GE61 having the enable voltage level VGL and time lengths of periods of the light emitting signal GE61 having the disable voltage level VGH are increased gradually with respect to the increasing of the corresponding gray levels. The scanning signal GS61 is decreased and has multiple slopes same as or different from each other when the light emitting signal GE61 has the disable voltage level VGH. The scanning signal GS61 is decreased and has the slope substantially equal to zero when the light emitting signal GE61 has the enable voltage level VGL. The pixel driving circuit 610 is able to cutoff the current passing through the pixel driving circuit 610 according to pinch off signals (such as the pinch off signal PPO shown in FIG. 2) during the periods that the light emitting signal GE61 has the disable voltage level VGH, to achieve desired gray levels.

Operations of the pixel driving circuit 610 during the periods P714, P715, P716-P718, P719, P720-P721 are similar with the operations of the pixel driving circuit 610 during the periods P74, P75, P76-P78, P79, P710-P711, respectively. Therefore, some descriptions are not repeated for brevity. In some embodiments, time lengths of the periods P79, P715 and P719 are increased gradually in order. In some embodiments, time lengths of the periods P710-P712 and P716-P718 are increased gradually in order.

Referring to FIG. 3 and FIG. 6, operations of the scanning signal GS61 and the light emitting signal GE61 during the periods P71-P721 are similar with the operations of the scanning signal GS and the light emitting signal GE during the periods P31-P315. For example, the period P71 corresponds to the period P31, the periods P72-P74 corresponds to the period P32, the period P75 corresponds to the period P33, the periods P76-P78 corresponds to the period P34, and the period P79 corresponds to the period P35.

As illustratively shown in FIG. 7, during the period P73, the scanning signal GS62 is decreased and has the first slope. The light emitting signal GE62 has the enable voltage level VGL. The pixel driving circuit 620 is able to cutoff a current passing through the pixel driving circuit 620 during the period P73, to determine a gray level of the pixel driving circuit 620.

As illustratively shown in FIG. 7, during the periods P74-P76, the scanning signal GS62 is decreased and has the second slope. The light emitting signal GE62 has the disable voltage level VGH. The pixel driving circuit 620 is able to cutoff the current passing through the pixel driving circuit 620 during the periods P74-P76, to determine the gray level of the pixel driving circuit 620.

As illustratively shown in FIG. 7, during the period P77, a slope of the scanning signal GS62 is substantially equal to zero. The light emitting signal GE62 has the enable voltage level VGL. The pixel driving circuit 620 emits light or not according to whether the current is cutoff during the periods P74-P76.

As illustratively shown in FIG. 7, during the periods P78-P710, the scanning signal GS62 is decreased and has the third slope. The light emitting signal GE62 has the disable voltage level VGH. The pixel driving circuit 620 is able to cutoff the current passing through the pixel driving circuit 620 during the periods P78-P710, to determine the gray level of the pixel driving circuit 620.

As illustratively shown in FIG. 7, during the period P711, a slope of the scanning signal GS62 is substantially equal to zero. The light emitting signal GE62 has the enable voltage level VGL. The pixel driving circuit 620 emits light or not according to whether the current is cutoff during the periods P78-P710.

In some embodiments, time lengths of the periods P74-P76 and P78-P710 are increased gradually in order. In some embodiments, time lengths of the periods P77 and P711 are increased gradually in order.

During the periods P712-P713, the pixel driving circuit 620 performs operations similar with the operations performed during the periods P73-P711. During the period P713, the light emitting signal GE62 is switched between the enable voltage level VGL and the disable voltage level VGH. Time lengths of periods of the light emitting signal GE62 having the enable voltage level VGL and time lengths of periods of the light emitting signal GE62 having the disable voltage level VGH are increased gradually with respect to the increasing of the corresponding gray levels. The scanning signal GS62 is decreased and has multiple slopes same as or different from each other when the light emitting signal GE62 has the disable voltage level VGH. The scanning signal GS62 is decreased and has the slope substantially equal to zero when the light emitting signal GE62 has the enable voltage level VGL. The pixel driving circuit 620 is able to cutoff the current passing through the pixel driving circuit 620 according to pinch off signals (such as the pinch off signal PPO shown in FIG. 2) during the periods that the light emitting signal GE62 has the disable voltage level VGH, to achieve desired gray levels.

Operations of the pixel driving circuit 620 during the periods P714-P716, P717, P718-P720, P721 are similar with the operations of the pixel driving circuit 620 during the periods P74-P76, P77, P78-P710, P711, respectively. Therefore, some descriptions are not repeated for brevity. In some embodiments, time lengths of the periods P711, P717 and P721 are increased gradually in order. In some embodiments, time lengths of the periods P78-P710, P714-P716 and P718-P720 are increased gradually in order.

Referring to FIG. 3 and FIG. 6, operations of the scanning signal GS62 and the light emitting signal GE62 during the periods P73-P721 are similar with the operations of the scanning signal GS and the light emitting signal GE during the periods P31-P315. For example, the period P73 corresponds to the period P31, the periods P74-P76 corresponds to the period P32, the period P77 corresponds to the period P33, the periods P78-P710 corresponds to the period P34, and the period P711 corresponds to the period P35.

As describe above, the light emitting signals GE61 and GE62 has the enable voltage level VGL and the disable voltage level VGH alternately (for example, during the periods P73, P75, P77 and P79), such that a total current passing through the display device 600 is decreased.

Figure 8:
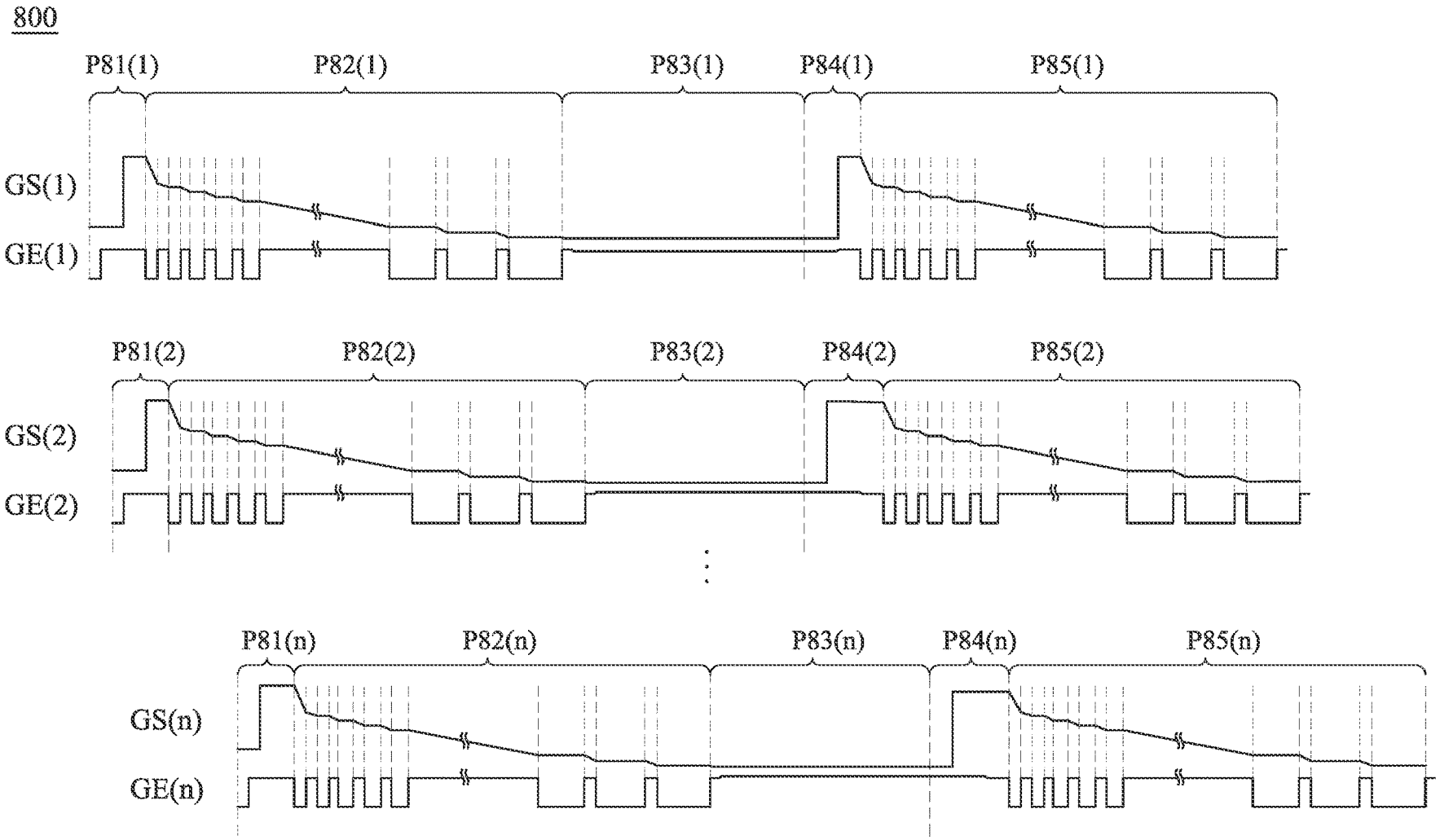
FIG. 8 is a timing diagram of a display device performing light emitting operations illustrated according to one embodiment of this disclosure.

FIG. 8 is a timing diagram 800 of the display device 110 performing light emitting operations illustrated according to one embodiment of this disclosure. The timing diagram 800 includes periods P81(*i*)-P85(*i*) arranged continuously in order. It is noted that i is an integer smaller than or equal to n. The timing diagram 800 corresponds to operations of scanning signals GS(i) and light emitting signals GE(i). Referring to FIG. 1 and FIG. 8, in some embodiments, pixel driving circuits DV(i) are configured to perform light emitting operations according to the scanning signals GS(i) and the light emitting signals GE(i). The operations performed by the pixel driving circuits DV(i) according to the scanning signals GS(i) and the light emitting signals GE(i) are similar with the operations performed by the pixel driving circuit 200 according to the scanning signal GS and the light emitting signal GE. Therefore, some descriptions are not repeated for brevity.

As illustratively shown in FIG. 8, waveforms of the scanning signals GS(1), GS(2), GS(n) and the light emitting signals GE(1), GE(2), GE(n) during the periods P81(1)-P85(1), P81(2)-P85(2) and P81(*n*)-P85(*n*). Waveforms of the scanning signals GS(3)-GS(n−1) and the light emitting signals GE(3)-GE(n−1) are not illustrated in FIG. 8 for brevity.

During the period P81(1), the pixel driving circuit DV(1) performs data writing operations similar with those performed during the periods P51-P55 shown in FIG. 5, such that a data signal is written into the pixel driving circuit DV(1).

During the period P82(1), the pixel driving circuit DV(1) performs light emitting operations similar with those performed during the period P57 shown in FIG. 5, such that the pixel driving circuit DV(1) emits light according to the data signal written during the period P81(1).

During the period P83(1), the pixel driving circuit DV(1) cutoff a current which is for the light emitting operations, such that the pixel driving circuit DV(1) does not emit light. In some embodiments, the period P83(1) is referred to as an emission blanking period.

During the period P84(1), the pixel driving circuit DV(1) performs reset operations similar with those performed during the periods P54-P55 shown in FIG. 5, such that voltages of nodes in the pixel driving circuit DV(1) are reset.

During the period P85(1), the pixel driving circuit DV(1) performs light emitting operations similar with those performed during the period P57 shown in FIG. 5, such that the pixel driving circuit DV(1) emits light according to the data signal written during the period P81(1).

In some embodiments, the periods P81(1)-P85(1) correspond to a frame time. During the frame time, the pixel driving circuit DV(1) performs one data writing operation (for example, the operation performed during the period P81(1)), and performs two light emitting operations (for example, the operations performed during the periods P82(1) and P85(1)) according to the written data signal, but embodiments of present disclosure are not limited to this. In various embodiments, in one frame time, the pixel driving circuit DV(1) is able to perform multiple light emitting operations according to the written data signal after the pixel driving circuit DV(1) performs one data writing operation. For example, in one frame time, the pixel driving circuit DV(1) performs multiple reset operations and light emitting operations corresponding to the periods P84(1)-P85(1).

In some approaches, in one frame time, a pixel driving circuit only performs one light emitting operation after a data writing operation. In such approaches, emission blanking periods are long during the frame time, such that flickers are severe.

Compared to the above approaches, in some embodiments of the present disclosure, in one frame time (for example, the periods P81(1)-P85(1)), the pixel driving circuit DV(1) multiple light emitting operations, such that a total light emitting period in the frame time is increased and the emission blanking periods are decreased. As a result, flickers of the display device are reduced.

As illustratively shown in FIG. 8, operations of the scanning signals GS(i) and the light emitting signals GE(i) during the periods P81(*i*)-P85(*i*) are similar with the operations of the scanning signals GS(1) and the light emitting signals GE(1) during the periods P81(1)-P85(1). Therefore, some descriptions are not repeated for brevity.

As illustratively shown in FIG. 8, the periods P81(1)-P81(*n*) are arranged in order. For example, the period P81(*i*+1) starts after the period P81(*i*) starts. In some embodiments, the period P81(*i*+1) and the period P81(*i*) may be partially overlapped.

Similarly, the periods P82(1)-P82(*n*) are arranged in order, the periods P83(1)-P83(*n*) are arranged in order, the periods P84(1)-P84(*n*) are arranged in order, and the periods P85(1)-P85(*n*) are arranged in order. As a result, multiple rows of pixel driving circuits in the display device 110 shown in FIG. 1 perform the light emitting operations in order according to the scanning signals GS(1)-GS(n) and the light emitting signals GE(1)-GE(n).

For example, during each of the periods P82(1)-P82(*n*), a corresponding one of the scanning signals GS(1)-GS(n) has the first slope, the second slope and the third slope in order. Due to the periods P82(1)-P82(*n*) are arranged in order, the scanning signals GS(1)-GS(n) have the first slope in order. Accordingly, the pixel driving circuits DV(1)-DV(n) emit light in order according to the first slope.

In some embodiments, the period P82(*i*+1) and the period P82(*i*) may be partially overlapped, the period P83(*i*+1) and the period P83(*i*) may be partially overlapped, and the period P84(*i*+1) and the period P84(*i*) may be partially overlapped.

The driving methods and the light emitting methods described above in present disclosure are for illustration purpose, other driving methods and light emitting methods are contemplated as within the scope of present disclosure.

In summary, in present disclosure, the pixel driving circuit 200 performs the light emitting operations of low gray levels during the period P31 according to the first slope, and performs the light emitting operations of middle gray levels and high gray levels during the periods P32-P315 according to multiple light emitting periods which are increased gradually in order, such that the pixel driving circuit 200 is able to control and adjust the gray level more accurately.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display device, comprising a plurality of pixel driving circuits coupled in series with each other, wherein a first pixel driving circuit of the plurality of pixel driving circuits comprises:

a light emitting element configured to emit light according to a current;

a first driving unit configured to generate the current;

a second driving unit configured to drive the first driving unit to adjust the current according to a first scanning signal; and a control unit configured to control the first driving unit to adjust the current according to a first light emitting signal, wherein the first scanning signal has a first slope, a second slope and a third slope during a first period, a second period and a third period, respectively, wherein the first slope, the second slope and the third slope are different from each other, the first light emitting signal has an enable voltage level during the first period and the third period, and has a disable voltage level during the second period, and the first period, the second period and the third period are arranged continuously in order.

2. The display device of claim 1, wherein the first slope is larger than the second slope, and the third slope is substantially equal to zero.

3. The display device of claim 1, wherein the first scanning signal has a fourth slope and a fifth slope during a fourth period and a fifth period, respectively, wherein the fifth slope is substantially equal to zero, and the first period, the second period, the third period, the fourth period and the fifth period are arranged continuously in order.

4. The display device of claim 3, wherein the first light emitting signal has the enable voltage level during the fifth period, and has the disable voltage level during the fourth period, wherein a time length of the fifth period is larger than a time length of the third period.

5. The display device of claim 1, wherein the first scanning signal is decreased during a plurality of decreasing periods, and the first scanning signal has a slope substantially equal to zero during a plurality of light emitting periods, wherein the plurality of decreasing periods and the plurality of light emitting periods are arranged alternately in a frame time, the second period corresponds to one of the plurality of decreasing periods, and, the third period corresponds to one of the plurality of light emitting periods.

6. The display device of claim 5, wherein the first light emitting signal has the disable voltage level during the plurality of decreasing periods, and has the enable voltage level during the plurality of light emitting periods.

7. The display device of claim 6, wherein time lengths of the plurality of light emitting periods are increased gradually in order in the frame time.

8. The display device of claim 5, wherein the plurality of light emitting periods corresponds to a plurality of first gray levels of the first pixel driving circuit, respectively, the first period corresponds to a plurality of second gray levels of the first pixel driving circuit, and the plurality of first gray levels are larger than the plurality of second gray levels.

9. The display device of claim 1, wherein a second pixel driving circuit of the plurality of pixel driving circuits is configured to perform light emitting operations according to a second scanning signal and a second light emitting signal, the second scanning signal has the first slope and the second slope during the second period and the third period, respectively, and the second light emitting signal has the enable voltage level during the second period, and has the disable voltage level during the third period.

10. The display device of claim 9, wherein the second scanning signal has a slope substantially equal to zero during a fourth period and a fifth period, and has a fourth slope not equal to zero during a sixth period, a time length of the fourth period is smaller than a time length of the fifth period, and a time length of the third period is smaller than a time length of the sixth period, and the second period, the third period, the fourth period, the sixth period and the fifth period are arranged continuously in order.

11. The display device of claim 9, wherein the first light emitting signal has the disable voltage level during a plurality of decreasing periods, the first light emitting signal has the enable voltage level during a plurality of light emitting periods, the second light emitting signal has the enable voltage level during the plurality of light emitting periods, the second light emitting signal has the disable voltage level during the plurality of decreasing periods, and the plurality of decreasing periods and the plurality of light emitting periods are arranged alternately in a frame time.

12. The display device of claim 1, wherein a second pixel driving circuit to an Nth pixel driving circuit are configured to perform light emitting operations according to a second scanning signal to an Nth scanning signal, respectively, wherein N is a positive integer larger than two, the first scanning signal to the Nth scanning signal has the first slope in order, and each of the first scanning signal to the Nth scanning signal has the second slope and the third slope in order after having the first slope.

13. The display device of claim 1, wherein the first pixel driving circuit is configured to perform a first light emitting operation and a second light emitting operation in order in a frame time, and configured to perform a reset operation between the first light emitting operation and the second light emitting operation.

14. An operating method of a display device, comprising:

adjusting a current according to a first scanning signal and a first light emitting signal;

adjusting a voltage level of the first scanning signal with a first slope, a second slope and a third slope during a first period, a second period and a third period, respectively, wherein the first period, the second period and the third period are arranged continuously in order;

adjusting a voltage level of the first light emitting signal to a enable voltage level during the first period and the third period;

adjusting the voltage level of the first light emitting signal to a disable voltage level during the second period;

the current flowing through a light emitting element; and the light emitting element emitting light based on the current.

15. The operating method of claim 14, further comprising:

adjusting the voltage level of the first scanning signal with a fourth slope and a fifth slope during a fourth period and a fifth period, respectively, wherein the third period, the fourth period and the fifth period are arranged continuously in order, wherein the third slope and the fifth slope are substantially equal to zero, and a time length of the fifth period is larger than a time length of the third period.

16. The operating method of claim 15, wherein the first slope is larger than each of the second slope and the third slope.

17. The operating method of claim 16, further comprising:

decreasing the voltage level of the first scanning signal during a plurality of decreasing periods; and maintaining the voltage level of the first scanning signal during a plurality of light emitting periods, wherein the plurality of decreasing periods and the plurality of light emitting periods are arranged alternately in a frame time, the second period and the fourth period correspond to two of the plurality of decreasing periods, and the third period and the fifth period correspond to two of the plurality of light emitting periods.

18. A pixel driving circuit, comprising:

a light emitting element configured to receive a current to emit light;

a driving unit configured receive a first scanning signal to adjust the current; and a control unit configured to receive a first light emitting signal to adjust the current, wherein a voltage level of the first scanning signal is decreased during a plurality of decreasing periods, and a voltage level of the first scanning signal has a slope substantially equal to zero during a plurality of light emitting periods, wherein the plurality of decreasing periods and the plurality of light emitting periods are arranged alternately in a frame time.

19. The pixel driving circuit of claim 18, wherein the voltage level of the first scanning signal is decreased with a plurality of slopes during a plurality of decreasing periods, and the voltage level of the first scanning signal is decreased with a first slope larger than each of the plurality of slopes during a first period in the frame time, before the plurality of decreasing periods.

20. The pixel driving circuit of claim 19, wherein the first light emitting signal has a disable voltage level during the plurality of decreasing periods, and has an enable voltage level during the plurality of light emitting periods and the first period.

* * * * *